US005086975A

United States Patent [19]

Paige

[11] Patent Number: 5,086,975

[45] Date of Patent: Feb. 11, 1992

[54] PRESSURE WASHER WITH SPRING-LESS OUTLET TO INLET BYPASS

[75] Inventor: Clive R. Paige, Winkfield, England

[73] Assignee: Shop Vac Corporation, Williamsport, Pa.

[21] Appl. No.: 634,063

[22] Filed: Dec. 26, 1990

Related U.S. Application Data

[63] Continuation of Ser. No. 462,733, Jan. 19, 1990, abandoned, Continuation-in-part of Ser. No. 297,620, Jan. 17, 1989, abandoned.

[51] Int. Cl.[5] ..... F04B 17/00

[52] U.S. Cl. ..... 239/124; 239/571; 92/167

[58] Field of Search ..... 137/563, 566, 567, 115; 417/440, 539; 92/167, 240; 277/78, 103, 173

[56] References Cited

U.S. PATENT DOCUMENTS

| | | | |
|---|---|---|---|
| 373,072 | 11/1887 | Jarvis | 92/167 |
| 3,524,465 | 8/1970 | Sadler | 137/115 |
| 3,529,626 | 9/1970 | Geeman | 137/563 |
| 3,606,904 | 9/1971 | Taylor | 137/115 X |
| 3,855,906 | 12/1974 | Mohrenstein-Ert et al. | 92/167 X |
| 4,182,354 | 1/1980 | Bergstedt | 239/126 X |
| 4,324,407 | 4/1982 | Upham et al. | 277/103 X |
| 4,385,690 | 5/1983 | Iverson | 239/137 X |
| 4,653,339 | 3/1987 | Kamatsu et al. | 92/167 |
| 4,951,713 | 8/1990 | Jordan et al. | 137/115 X |

FOREIGN PATENT DOCUMENTS 0207501 7/1986 European Pat. Off. .

88/01912 3/1988 World Int. Prop. O. .

*Primary Examiner*—Andres Kashnikow
*Assistant Examiner*—Kevin Weldon
*Attorney, Agent, or Firm*—Ostrolenk, Faber, Gerb & Soffen

[57] ABSTRACT

A pressure washer for delivering a liquid under high pressure has an inlet conduit connected to a liquid supply and an outlet conduit connected to a spray nozzle which can be operated to control the delivery of liquid through the nozzle. A bypass conduit enables recirculation of the liquid from the outlet conduit to the inlet conduit. A bypass system, disposed between the outlet conduit and the bypass conduit, includes a shuttle valve which moves between first and second positions at which it respectively blocks or opens the liquid path from the outlet conduit to the bypass conduit. The shuttle includes an axial passage from its inlet to its outlet side which passage has a narrowed jet outlet such that, when the liquid flows through the spray nozzle and the outlet conduit, the pressure drop across the shuttle moves the shuttle to the first position, while when the flow out the spray nozzle is stopped or significantly blocked, pressure on the side of the shuttle facing the spray nozzle rises to the level at the inlet side of the shuttle, which moves the shuttle to unblock the bypass conduit. A seal arrangement in the pressure washer pump comprises a pair of seals between each piston and cylinder wall of the pump. One of the seals pivots in response to side to side wobbling of the piston while maintaining the seal.

25 Claims, 5 Drawing Sheets

PRESSURE WASHER WITH SPRING-LESS OUTLET TO INLET BYPASS

CROSS REFERENCE TO RELATED APPLICATIONS

This is a Continuation of U.S. application Ser. No. 07/462,733, filed Jan. 19, 1990, now abandoned which is in turn a Continuation-In-Part of U.S. application Ser. No. 07/297,620, filed Jan. 17, 1989, now abandoned and entitled Pressure Washer, the contents of which are incorporated by reference herein.

BACKGROUND OF THE INVENTION

Generally, the present invention relates to a pressure washer which pumps liquid from an external source and supplies it to a spray nozzle at high pressure, typically even higher than 1,000 psi. More specifically, the invention relates to a bypass system, disposed between the liquid outlet and the liquid inlet of the pump of the pressure washer. The bypass system serves to regulate or relieve the pressure at the liquid outlet of the pump, both when the pressure washer is operating and the pump is pumping and when the pump is turned off. The system of the present invention prevents over-pressurization of the liquid at the liquid outlet and avoids the possibility that an undesirable initial burst of pressurized liquid will shoot through the spray nozzle, should the spray nozzle be turned on while the pump is off.

The pressure washer of the present invention may be embodied in a standing or portable version. In the standing version, a pumping section of the washer stands on the floor and has an elongated hose leading to a hand-held spray nozzle. The pathway through which the liquid is pumped to the spray nozzle is selectively openable to permit the liquid to be sprayed from the spray nozzle and closable to halt the spray of liquid. The portable version is, on the other hand, comprised of a single, portable, hand-held unit combining the nozzle with the pumping unit.

Some pumps are designed to operate only when liquid spraying is required. In the standing form of the pressure washer, on the other hand, the pump is typically operated continuously whether the liquid pathway to the spray nozzle is open or closed. Consequently, the standing pressure washer requires protection of the pump from overheating and other effects when the liquid pathway which is controlled by the spray nozzle is closed while the pumping action continues. Another type of protection is against excess pressure in the system downstream of the pump, due, for instance, to a blockage. One known technique for protecting the continuous pumping washer system comprises selective bypassing of pumped liquid from the pump outlet back to the pump inlet when the liquid pathway is closed. A valve controls the bypass arrangement to permit bypass recirculation at a lower pressure to prevent overheating of the pump elements.

However, even in a pressure washer in which the pump is turned off when liquid spraying is halted, a problem exists in conventional pumps in that the pump motor shuts down gradually, not instantly. As a result, with the pump motor off and the spray nozzle closed, the gradual stopping of the pump motor has the effect of pressurizing the output chamber of the pressure washer, with the undesirable result that when the spray nozzle is actuated while the pump is off, there is an initial burst of highly pressurized liquid through the nozzle.

Further, often the pressure washer is used to pump liquid, particularly water at high pressure. When the water is used for cleaning purposes, it is sometimes desired to mix with it another liquid, for example, a detergent, a chemical, or the like. Appropriate mixing means are then needed for controllably mixing the additional liquid with the water being pumped. Various such mixing means are known in the art, but conventionally these known mixing devices have been provided separately and independently of the aformentioned bypass system. This complicates the construction and adds to the cost of pressure washers.

Many known pressure washers use piston/cylinder pumps, in which the piston is reciprocated by various means. It is further known and preferred to provide multi-piston pumps to optimize the balance, speed, torque, bearing life, valve design, flow rate, efficiency, and the spray characteristics, e.g. spray continuity and uniformity, of the pressure washer. In one multi-piston pump, the pistons are driven in a manner wherein they tend to wobble or swash as they reciprocate within their cylinders and move past a stationary resilient seal. It is therefore essential to provide a piston sealing arrangement which can withstand the wobbling/swashing of the pistons while still providing good sealing and a simple and easy to service piston sealing construction.

SUMMARY OF THE INVENTION

It is an object of the present invention to provide a pressure washer for pumping liquid through a spray nozzle at elevated pressures.

It is another object of the invention to provide a pressure washer which is able to develop and maintain correct pressure conditions in the outlet conduit leading to the spray nozzle of the washer, while the washer is operating and also when it is turned off.

A still further object of the invention is to provide a simplified bypass system in a pressure washer in which the same unit has the ability to both bypass liquid from the outlet conduit to the inlet conduit of the pressure washer and to mix additional liquid with the liquid being pumped.

Yet a further object of the invention is to provide an improved sealing arrangement for a multi-piston washer pump for sealing each pump cylinder around its respective piston.

The foregoing and other objects of the present invention are realized by a pressure washer which is capable of delivering liquid under pressure. The pressure washer of the present invention includes a spray nozzle for spraying liquid, an outlet conduit connected for delivering liquid to the spray nozzle and an inlet conduit for receiving liquid from a liquid supply. A pump, preferably a multi-piston pump, is connected between the inlet conduit and the outlet conduit and is effective for pumping liquid from the inlet conduit to the outlet conduit.

The spray nozzle has associated with it actuation means which enable selective opening and blocking of the exit of liquid pumped by the pump from the spray nozzle. A bypass conduit connected between the inlet conduit and the outlet conduit is disposed in parallel with the pump.

A liquid bypass system is associated with the bypass conduit and permits selective closing and opening of the bypass conduit. The bypass system includes a bypass chamber which is in liquid communication with the bypass conduit. The bypass chamber has a chamber inlet in liquid communication with the outlet conduit, a main chamber outlet in liquid communication with the spray nozzle and a separate bypass chamber outlet to the bypass conduit. A valve shuttle moves in the bypass chamber between first and second positions. In the first forward position of the shuttle, the shuttle blocks fluid communication between the bypass chamber and the bypass conduit, while in the second rearward position, the shuttle enables fluid communication between the bypass chamber and the bypass conduit.

The shuttle has a first surface area which is exposed to liquid pressure at the chamber inlet side of the shuttle and a second surface area which is exposed to liquid pressure at the main chamber outlet side of the shuttle. The first and second surface areas of the shuttle and the shuttle itself are so constructed and dimensioned that the first inlet side surface area is smaller than the second outlet side surface area whereby when the force on both ends of the shuttle is the same, the differences in the first and second surface areas urges the piston rearwardly in the bypass chamber.

A liquid flow passage passes axially, i.e., longitudinally, through the shuttle from the first to the second surface area thereof. The passage is narrowed such that there is a higher pressure jet flow from the small passage outlet. Preferably, the passage has a first larger cross-section over the major part of its length in from the first surface and has a second smaller cross-section over the rest of its length to the second surface. The reduced cross-section of the passage inherently causes a pressure drop through the shuttle channel, and a jet of liquid will exit through the second surface. The larger cross-section passage with a narrowed exit region more efficiently produces a pressure drop than might a longer uniformly narrowed tube. This inherent pressure drop has a valuable function, described below.

The shuttle has a substantially circular external cross-section. It has first and second seals which are disposed longitudinally spaced apart along the length of the shuttle. Each seal extends circumferentially around the shuttle and defines the periphery of the shuttle and the cross-section of the shuttle at the seal. The first seal seals the bypass chamber inlet from the bypass conduit in the first position of the shuttle but opens communication between the bypass chamber inlet and the bypass conduit in the second position of the shuttle. The second seal seals the chamber outlet from the bypass conduit in all positions of the shuttle. The first seal defines a first smaller cross-section for the first rearwardly facing surface area of the shuttle facing the inlet conduit. The second seal defines a second larger cross-section area for the second forwardly facing surface area of the shuttle facing the outlet conduit.

In a preferred embodiment, the bypass chamber has first, second and third axially or longitudinally extending and cross-sectionally different sized regions. The first region, which is toward the inlet side of the chamber and toward which the smaller first shuttle surface area faces, has the largest diameter, the second region, which is toward the outlet side of the chamber and toward which the larger second shuttle surface area faces has an intermediate diameter, and the third region, which is disposed axially between the first and second regions, has the smallest diameter. The bypass conduit is in fluid communication with the third region in the bypass chamber. The first seal is located on the shuttle such that it is moved between the first and third regions of the bypass chamber as the shuttle changes positions. The first seal has the same cross section as the third bypass chamber region, whereby the first seal is in sliding contact with the side wall of the third region and seals the inlet conduit from the bypass conduit when the shuttle is forward in the first position and the communication between the inlet and the bypass conduit is open when the first seal is in the first chamber region. The second seal is so located on the shuttle and the second seal has the same cross section as the second chamber region such that the second seal at all times is in sliding contact with the side wall of the second region in the bypass chamber.

In a further developed version of the bypass system of the invention, a further liquid conduit debouches into the bypass chamber at the third region for enabling introduction into the bypass chamber of an additional fluid for being mixed with the liquid being pumped by the pressure washer. Preferably, the bypass system, in the region of the chamber outlet, further defines a venturi which sucks in the additional fluid.

It is also preferred that the pump of the invention be comprised of a multiple piston pump wherein each section of the pump has a cylinder and a piston which reciprocates in the cylinder. The piston has a cross-sectional size which is smaller than the interior diameter of the cylinder, thereby defining a clearance between the cylinder and the piston. First and second sealing rings extend between the piston and the cylinder sealing the clearance.

More particularly, the first sealing ring is disposed within a notch in the wall of the cylinder and the second sealing ring is partially in the notch and partially in the clearance between the cylinder and the piston. There is also a clearance above the second sealing ring which enables the piston to wobble relative to the axis of the cylinder while maintaining a liquid tight seal between the first and second sealing rings and also between the second sealing ring and the wall of the piston.

Other features and advantages of the present invention will become apparent from the following description of the invention which refers to the accompanying drawings.

DETAILED DESCRIPTION OF THE DRAWINGS

Figure 1:
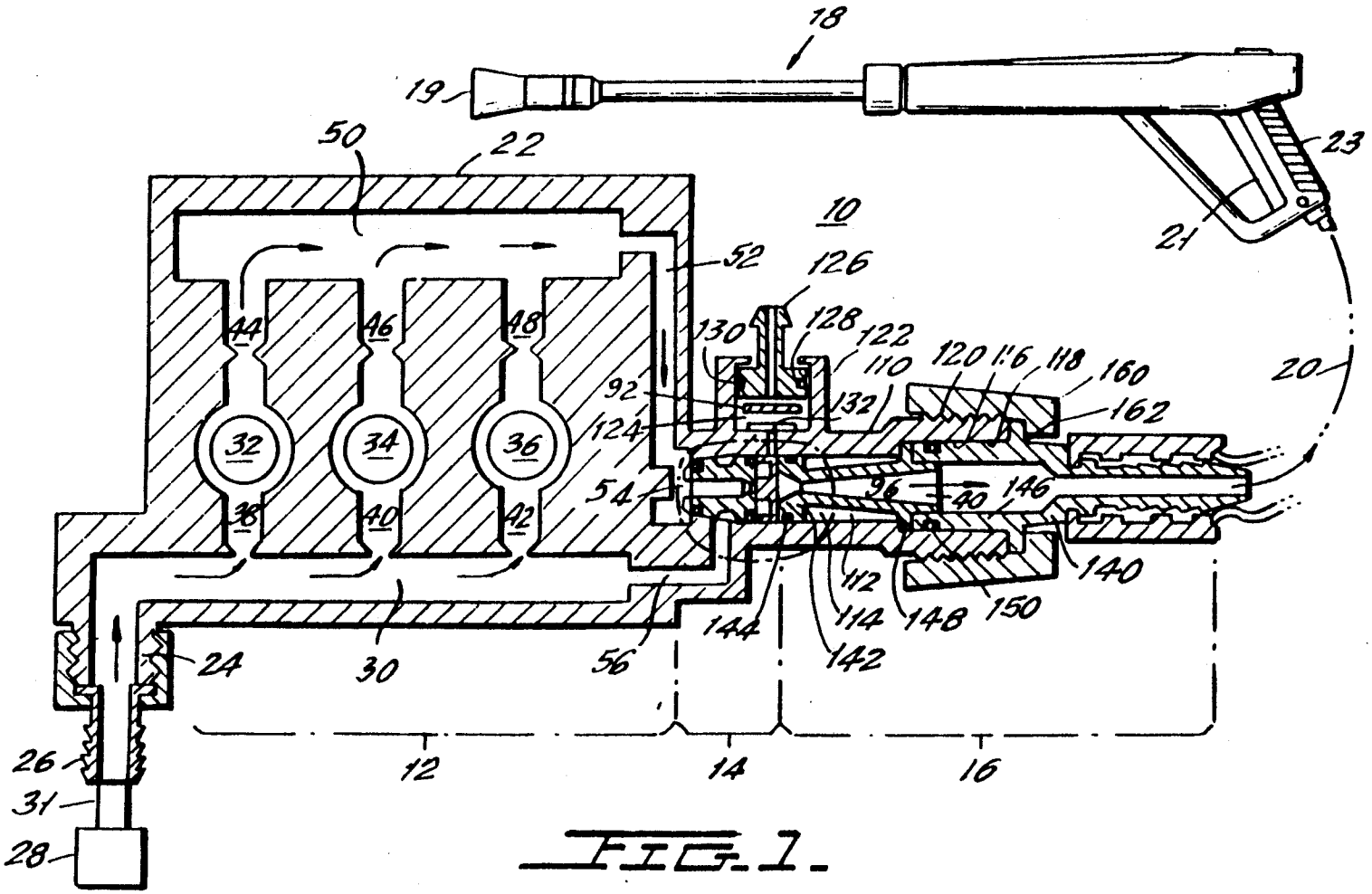
FIG. 1 is a schematic longitudinal cross-section in plan view of a pressure washer according to the present invention.

Referring to FIG. 1, a pressure washer 10 in accordance with the present invention essentially comprises a pump module 12 for delivering liquid at an elevated pressure to a spray gun and hose assembly 18, through a combined bypass and chemical injection system 14 and a hose coupling section 16.

The entire pressure washer 10 can be embodied as a single, hand-held, portable unit, with the spray gun assembly 18 mechanically and essentially inflexibly secured to the section 16, in a manner which allows an operator to carry the entire unit to a location where spraying of articles or material with liquid is needed.

Alternatively, the pressure washer 10 of the present invention may be embodied in a standing version. In the standing version, the pumping module 12, bypass system 14, and hose coupling section are in one housing 22 which stands on the floor, and an elongate hose 20 leads to the hand held spray gun assembly 18.

The pumping module 12 is essentially disposed within a block or housing 22. The housing 22 has an externally threaded inlet fitting 24 which is able to receive an externally threaded coupling 26. The coupling 26 is connectable with a supply 28 of wash liquid, typically water. The liquid supply 28 may be the water tap of a conventional water supply or a hose 31 leading from a reservoir 28.

The inlet fitting 24 has a liquid channel which communicates into a common inlet conduit 30 which supplies each of the three below-described pumping cylinders 32, 34, and 36 with water, each cylinder being supplied through its respective input conduit 38, 40 and 42. Each cylinder 32, 34, 36 also has a respective output conduit 44, 46, 48 which leads into a common outlet conduit 50. The three cylinders 32, 34, and 36 are connected in parallel with one another, extending between the inlet conduit 30 and the outlet conduit 50. Since the wash liquid is pumped through all three cylinders to the outlet conduit 50, a significant pumping pressure is developed and other advantages are obtained as well, e.g., optimized balance, speed, torque, bearing life, valve design, flow rate, efficiency, and spray continuity and uniformity.

The pressurized wash liquid in the outlet conduit 50 is thereafter directed through a further, L-shaped conduit 52 to an inlet chamber portion 54 of the bypass system 14.

The bypass system 14 serves to divert pumped wash liquid from outlet conduit 50 of the pump module 12 to a bypass conduit or gallery 56 which leads back to the low pressure inlet conduit 30 of the pump 12.

Figure 3:
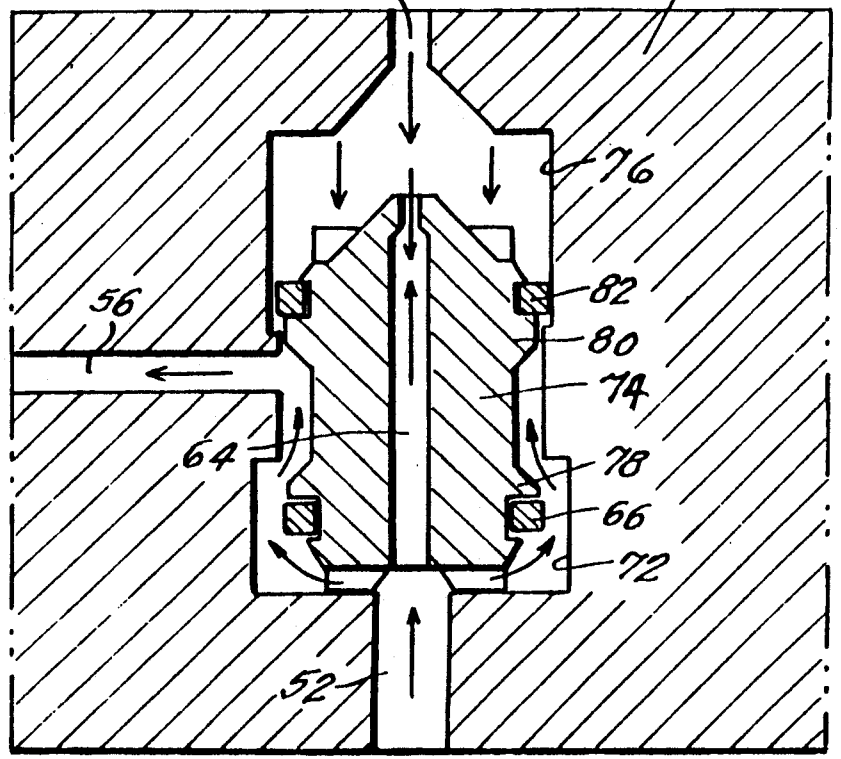
FIG. 3 shows the bypass valve of FIG. 2 with the shuttle in a second position.
Figure 2:
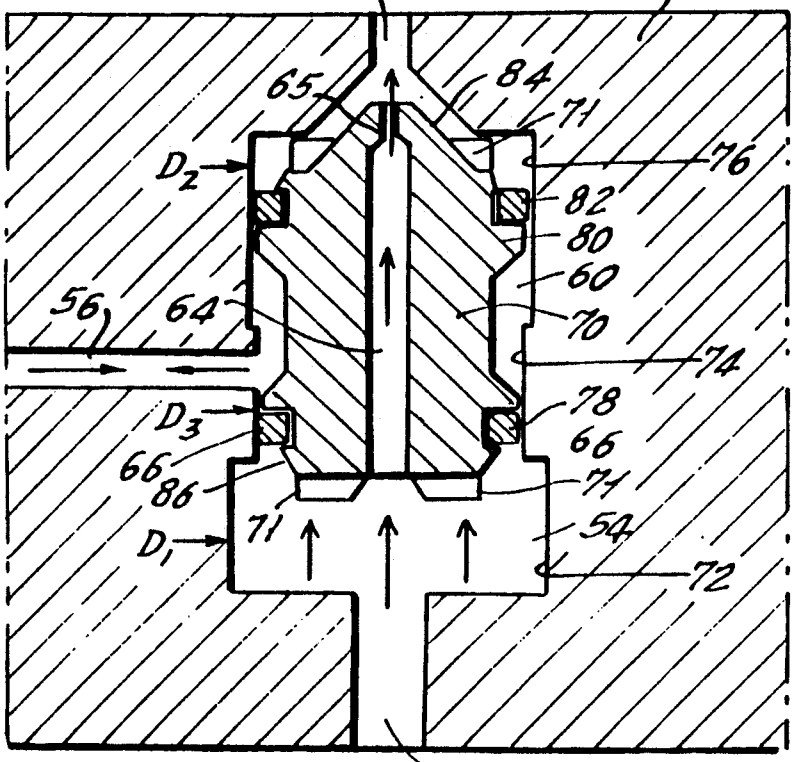
FIG. 2 is a cross-section through a bypass valve located between the outlet and the inlet of the pressure washer and with a shuttle of the bypass valve in a first position.

Referring to FIGS. 2 and 3, the bypass system 14 is shown diagrammatically to consist of a block in the form of a housing 58 in which there is defined a bypass chamber 60 through which wash liquid flows from the conduit 52 into the inlet chamber portion 54, then through a liquid passage 64 which has two different cross-sections including the narrower cross-section outlet region 65 toward the outlet conduit 62 and is formed in below described shuttle valve 70, and finally to an outlet conduit 62 of the bypass system 14. From there, the liquid flows to the gun assembly 18, and exits from the nozzle 19 thereof when the hand operated trigger 21 is actuated (FIG. 1).

The shuttle 70 is a piston, which is axially movable along the bypass chamber 60. Its axially extending, two different cross-section, always open passage 64, 65 enables liquid to flow therethrough to the outlet pipe 62, in all positions of the shuttle 70. On the other hand, the shuttle 70 is capable of either sealing off or enabling liquid flow from the conduit 52 to the bypass conduit 56.

In the bypass conduit blocking position, the shuttle 70 is disposed in a first forward position nearer the outlet conduit 62, as shown in FIG. 2. In that position, a first circumferential seal 66, e.g. an O-ring or the like, of the shuttle 70 seals the bypass conduit 56 from the inlet chamber 54. In its second rear position in FIG. 3, the shuttle 70 is disposed adjacent the inlet conduit 52.

The bypass chamber 60 has three regions having different respective cross-section or diameters, spaced axially along it. A first rearward region 72 of the chamber 60, which region 72 is disposed toward the inlet conduit 52, has the largest diameter D1. A second forward region 76, which is disposed toward the outlet conduit 62, has an intermediate diameter D2. A third region 74, which is located between the other two regions 72 and 76, has the smallest diameter D3. The bypass conduit 56 communicates into the chamber 60 at the third region 74.

The shuttle 70 has a first annular projection 78 which supports and disposes the first seal 66 against the interior wall of the chamber 60 in the first position of the shuttle 70. The seal 66 has the same diameter D3 as the third region 74 of the chamber. Toward its other axial end, the shuttle 70 has a second annular projection 80 which supports a second circumferential seal 82. The second seal 82 has the same diameter D2 as the second region 76 of the chamber 60.

The first seal 66 is so designed that it either slides over and provides a seal against the interior surface of the chamber 60 in the third region 74, in the first position shown in FIG. 2, or so that it moves through and faces but is radially spaced from the interior surface of the first region 72, as in the second position shown in FIG. 3. In contrast, the second seal 82 is disposed, in all positions of the shuttle 70, in sealing contact with the interior wall in the second region 76.

The diameter D2 of the second seal 82 is greater than the diameter D3 of the first seal. If the pressure at both ends of the shuttle against both end surfaces defined by the seals 66 and 82 were the same, the shuttle would always move rearward to the second position of FIG. 3. But that does not happen, for the reason now discussed.

Figure 4:
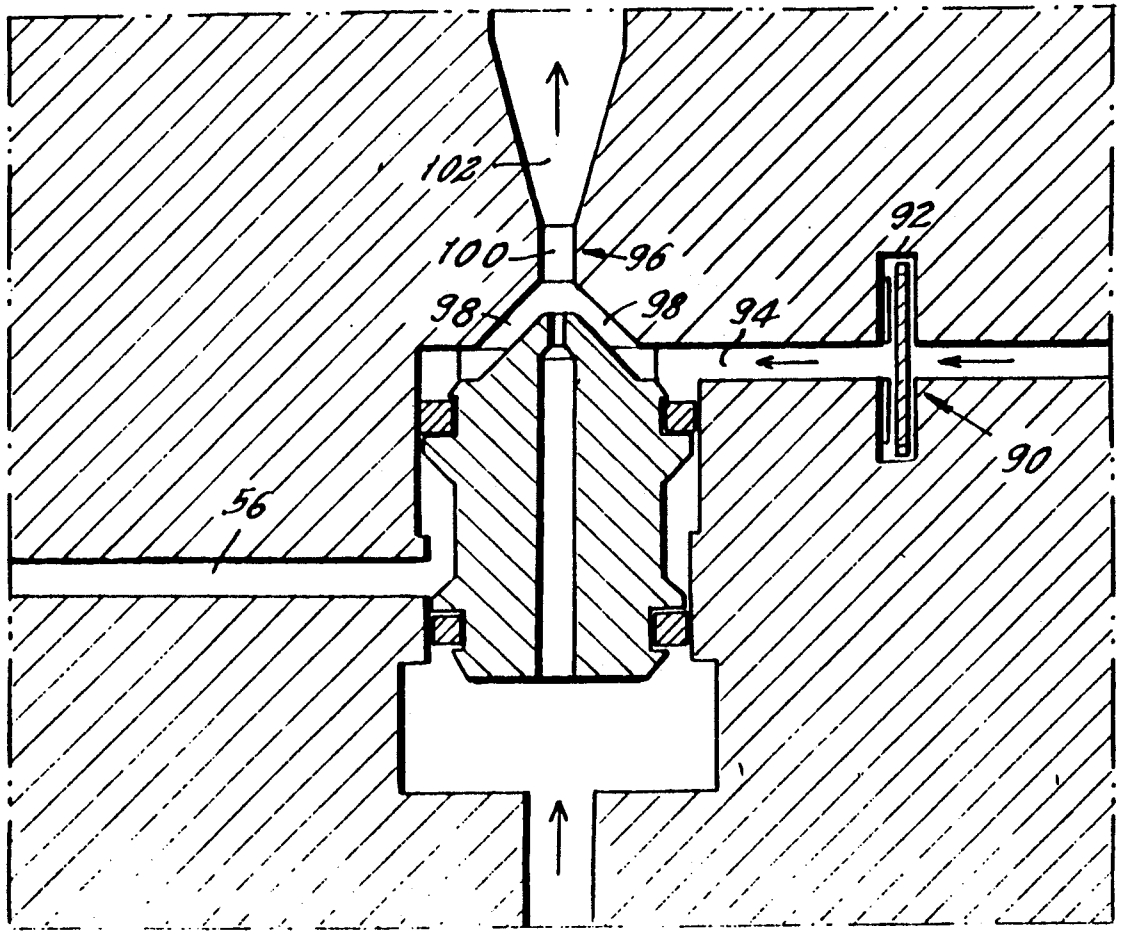
FIG. 4 is a cross-section through a modification of the bypass valve of FIG. 2, which incorporates an additional coupling for receiving an additional liquid for being mixed with the water being pumped by the pressure washer.

As shown in FIGS. 2–4, the passage 64 through the shuttle 70 has a wider cross-section first end region toward the inlet side at the first region 72 of the chamber, and the passage 64 has a narrowed cross-section second end region 65 toward the second region 76 of the chamber. The narrowing of the passage at 65 causes a pressure drop through the passage 64 and across the shuttle and produces a jet to exit at the second surface of the shuttle, past the narrowed passage end region 65 and into the bypass chamber second region 76. The pressure drop reduces the fluid pressure in the second region 76 of the chamber as compared with the pressure in the first region 72 thereof. The passage end region 65 is narrowed enough that the jet exiting from it produces a sufficient pressure differential at the first and second surface areas that the shuttle 70 will shift rearwardly to the position of FIG. 3 when the outlet flow through conduit 62 is blocked, and without assistance from any other element to urge the shuttle rearwardly. Operation of the shuttle is now described.

When the trigger 21 of the gun assembly 18 is actuated, the wash liquid is freed to escape from the outlet conduit 62. Were the passage 64 of uniform cross-section along its length and of large enough cross-section, the pressure in the entire bypass chamber, on both sides of the shuttle 70, in both first and second chamber regions 72 and 76, would be the same, and the shuttle would be pushed rearward to the second position of FIG. 3 because the seal 82 and the surface area it defines is of greater diameter than the seal 66 and the surface area it defines. But because of the narrowed region 65 of the passage 64, the flow through the passage produces a pressure drop across the shuttle, so that the pressure in region 72 is greater than that in the region 76, and despite the differences in the diameters of the seals, the shuttle 70 is moved forward to the position in FIG. 2, which blocks outlet to the bypass conduit 56. The pressure differential pushes the shuttle 70 forward, placing the first seal 66 as shown in FIG. 2 and thus blocking off the bypass outlet 56. Wash liquid then flows only through the passage 64 to the outlet conduit 62.

In this mode, the liquid is accelerated in the narrowed portion 65 of the orifice 64 and exits through the outlet conduit 62.

When the trigger 21 is released, the outlet conduit 62 is closed. As no liquid flows out of conduit 62, no liquid flow through passage 64 and 65. A pressure drop does not occur. The respective pressures at the opposite longitudinal ends of the shuttle 70 quickly become identical as there is no liquid flow. However, since the first seal diameter D2 at the front surface area 84 of the shuttle 70 is larger than the second seal diameter D3 at the rear surface area 86 of the shuttle 70, the same pressure applied to the different surface area ends of the shuttle causes a thrust imbalance across the shuttle 70 and urges the shuttle rearward to the position shown in FIG. 3 without need for assistance of another element.

In the rearward shuttle position shown in FIG. 3, the first seal 66 is at an axial shifted position where it is spaced from the interior wall of the chamber 60. This allows liquid to pass around the rear of the shuttle 70 and into the bypass conduit 56 so that it can recirculate through the pump cylinders 32, 34 and 36.

Not only does the shuttle play an important role upon the spray gun spraying and not spraying, it also reduces the stored pressure behind the spray gun valve when the pump is turned off after the spray gun has been closed. Normally, that closure would leave a high pressure head behind the spray gun valve and in front of the pump. A user would not know there is a danger that operation of the trigger with the pump off would still cause an immediate high pressure spurt through the spray nozzle, and that spray could hurt someone or something in its path. With the shuttle of the invention, when spraying stops and the pump is off, the pressure head behind the spray gun valve in a static non-flow situation will drive the shuttle 70 to the rear position of FIG. 3, far enough to open the path to the bypass conduit 56 back through the passage 64 and the chamber region 72, and that will drain off enough pressure from conduit 62 to prevent a dangerous spray in the inoperative condition of the spray gun.

The shuttle also compensates for excess pressure or unexpected bursts of pressure by the pump or for blockages somewhere in the passage through the outlet conduit 62 due, for instance, to dirt in the wash liquid that lodges in the pathway. This will reduced the cross-section of the path out of the bypass chamber, increase the pressure in the second downstream chamber region 76 and drive the shuttle 70 rearward, which also opens the path to the bypass conduit out of the first upstream chamber region 72. The pump thereby never has to pump into high counterpressure and the pump will therefore not be damaged through any of the unexpected variations in pumping and spraying conditions.

A plurality of axial protrusions 71 on each end of the shuttle 70 act as axial separation stops for the shuttle 70. These protrusions do not interfere with the flow of wash liquid.

Thus, the bypass system 14 of the present invention realizes the primary aim of the invention in that water is bypassed from the outlet conduit 50 to the inlet conduit 30, through the bypass conduit 56, whenever the path of liquid from the outlet conduit 62 is closed or blocked in part or totally or, in other words, whenever the liquid pressure at the outlet conduit 62 is equal to or greater than the liquid pressure in the inlet conduit 52. For example, after the trigger 21 is released, the gradual stopping of the motor will not result in an excessive build up of liquid pressure in the outlet conduit 62 which could cause a subsequent undesired, unexpected initial burst of pressurized liquid from the nozzle on the next occasion when the trigger 21 is actuated.

The bypass system depicted in FIGS. 2 and 3 does not require a shuttle 70 having a circular cross-section. The bypass system of the present invention might also be constructed with a bypass chamber 60 and shuttle 70 having a square, rectangular or any other cross-sectional shape, although sealing of the bypass conduit 56 is easier with a shuttle 70 having a circular or elliptical cross-section. No other biasing element, like a spring, is shown for the operation of the shuttle.

FIG. 4 illustrates (diagrammatically) a further development of the bypass system 14 which includes a chemical injection system 90 by which fluid such as a chemical, a detergent, etc., may be injected through a one-way valve 92 into a pipe 94 which leads into the bypass chamber 60, into a location therein which defines the beginning of a venturi chamber 96. The venturi chamber 96 has first, second and third sections 98, 100, 102. The first section 98 has a diameter which narrows in the liquid flow direction, a constant diameter at the section 100, and widening diameter in the section 102.

Fluid travelling through the bypass system 14 at considerable speed causes a drop in pressure in the venturi section 98 where the fluid flows as a jet stream after it exits the narrowed passage 65. This causes chemicals to be drawn through the one-way valve 92 into the jet stream. In conventional chemical injection systems in which a separate chemical injection system is provided following the outlet of the pump, for proper operation, the difference in pressure between the liquid pressure developed by the pump and the pressure at a point located at the largest diameter cross-section of the liquid conduit outside the venturi has to be large enough to obtain a minimum required fluid velocity. This usually requires that the jet diameter of the liquid issuing from the pump be relatively small. However, this has the general disadvantage that it reduces the jet power at the nozzle when the chemical injector is not being used, i.e., at high pressure jetting. This effect is due to the pressure differential losses across the chemical injection jet. These losses have a smaller effect as the pressure increases and the flow rate is reduced.

However, in the present invention where the chemical injection system and the bypass system are combined, the jet from the chemical injection aids in developing the pressure differential for the shuttle operation and bypass losses are eliminated. This also removes the need for two jets and accompanying seals.

The shuttle 70 of the present invention also acts as an over-pressure venting device, should the outlet nozzle 19 in the gun assembly 18 become partly blocked. The shuttle design of the present invention prevents high pressure from developing at the outlet conduit 50 of the pump 12 under all conditions, including when the outlet nozzle has been closed intentionally or unintentionally or after the pump has stopped, an important safety feature.

While FIGS. 2–4 illustrate diagrammatically the concept of the bypass and chemical injection system 14, FIG. 1 illustrates an embodiment of the invention in which the housing 22 of the pump has a neck 110 which defines an internal chamber 112 in which the bypass system 14 (essentially the shuttle 70) and a hose coupling described below are seated. The neck 110 defines a first bore 114 of a first diameter and a second larger diameter bore 116 which extends to an opening 118. At the opening 118, the neck 110 is externally threaded at 120.

The present invention is assembled by inserting the shuttle 70 with its seals 66 and 82 through the opening 118 in the neck 110, deep toward the inlet chamber 54. Behind it, a hose coupling comprised of a block 140 is inserted into the chamber 112. The front of the block 140 has a portion 142 of about the same diameter as the first bore 114 and supports a first O-ring seal 144. A second portion 146 of the block 140 has a larger diameter and defines a shoulder 148 which acts as a stop that determines the degree to which the hose coupling can be inserted into the bore 112 of neck 110. A second O-ring seal 150 further ensures that fluid will not leak past the hose coupling and out through the front opening 118 of the neck 110.

The venturi 96 of FIG. 4 is defined in the block 140.

A ferrule 160 has a flange 162 which engages an annular flange on the block 140 and is internally threaded and screwed on the threaded end of the neck 110, in a manner which secures the block 140 to the neck 110. The free end of the block 140 contains means for receiving and securing in place the end of hose 20.

The neck 110 is further formed with a radially extending wall 122 which defines a chamber 124 for the one-way valve 92 and a fluid conduit coupling 126 of the chemical injection system. The coupling 126 has a block 128 of a diameter about equal to the internal diameter of the chamber 124 and supports thereon an O-ring 130. An orifice 132 formed in the axially extending wall portion of the neck 110 provides a fluid communication path between the chemical injection chamber 124 and the first bore 114 in the neck extension 110.

Note that the degree of penetration of the hose coupling block 140 is such that the orifice 132 for chemical injection is disposed approximately at the boundary region between the block 140 and the shuttle 70. Further, the degree of penetration of block 140 is such that enough space is left in the internal chamber 112 of neck 110 to enable the shuttle 70 to move back and forth in the manner described in relation to FIGS. 2 and 3.

The gun assembly 18 comprises a liquid spraying device in the form of a gun having a handle 23 with a trigger 21 which can be actuated to permit high pressure fluid to flow through the gun for being sprayed on an article. The gun assembly 18 can be constructed to produce a plurality of different spraying patterns in accordance with the teaching of a U.S. Pat. No. 4,976,467, entitled Liquid Spray Nozzle. The contents of that patent are incorporated by reference herein.

As shown in FIG. 1, there are three pump cylinders 32, 34 and 36 which are identical in construction. One of them is now described by reference to FIG. 5. Thus, the cylinder 32 communicates through the input conduit 38 with the inlet conduit 30. A one-way input valve 170 only permits the liquid to enter the cylinder 32 and the pressure in the cylinder 32 is reduced. When the pressure in the cylinder 32 is reduced, the pressure in the inlet conduit 30 presses upon the valve element 172 to raise it off its seat 174, and against the bias of the one-way return spring 176.

The output conduit 44 from the cylinder 32 to the outlet conduit 50 is also blocked by a one-way output valve 178. When the pressure in the cylinder 32 increases, the valve element 180 is raised off its seat 182, and against the bias of the spring 184 until the output conduit 44 communicates into the outlet conduit 50.

Pumping of liquid first into the cylinder 32 and then out of the cylinder is accomplished by the piston unit 190. It comprises the piston 192 with the head 194 that reciprocates in the cylinder 23. The piston head 194 is enclosed and surrounded by a cup-shaped cover 196 comprised of a smooth surface, but hard and durable ceramic material. The cover 196 is sized and shaped and the cylinder 32 is of a width that there are clearance spaces 198 along the sides of the piston head cover 196 to allow for the below-described lateral movement or wobble of the piston without the piston contacting the sides of the cylinder 32.

To seal the cylinder 32 around the wobbling piston head cover 196, particularly in view of the clearance spaces 198, the piston is surrounded by a static seal 200 comprising a U-shaped strip of resilient material with one leg normally biased inwardly against the side of the piston and the other leg held in the notch 202 below the cylinder block. The seal 202 is supported from below by the seal support 204 in the notch 202. The pressure inside the cylinder 32 forces the inward leg of the seal against the below-described cover 196 which surrounds the piston head 194.

The cover 196 slides over the piston head 194 and comprises its peripheral wall and presents a surface against which the seal 200 slides as the piston 190 reciprocates. The cover 196 contacting the seal 202 defines a fulcrum for pivoting of the piston 190, causing wobbling or lateral movement as the piston 190 reciprocates.

The piston unit 190 continues at piston rod 210 below the cylinder 32 into the housing 212 around it, as described below. The piston unit 190 is integral with the piston rod unit 210 which comprises the non-rotatable ring 214 at the bottom end of the rod of the piston 192, the ball bearing 216 within the ring 214, an eccentric bush 218 which rotates inside the bearing 216, and the rotating crank pin 220 at the center to which the bush 218 is secured.

Rotation of the crank pin 220 in turn rotates the respective eccentric bush 218. The eccentricity of the bush causes the ring to wobble eccentrically and that carries along the piston 192 so that the piston reciprocates up and down in the cylinder 32 and also wobbles left and right as it reciprocates up and down. The seal 202 around the piston cooperates with the cover 196 on the piston to prevent leakage through the clearance spaces 198 past the piston head 194.

Figure 6:
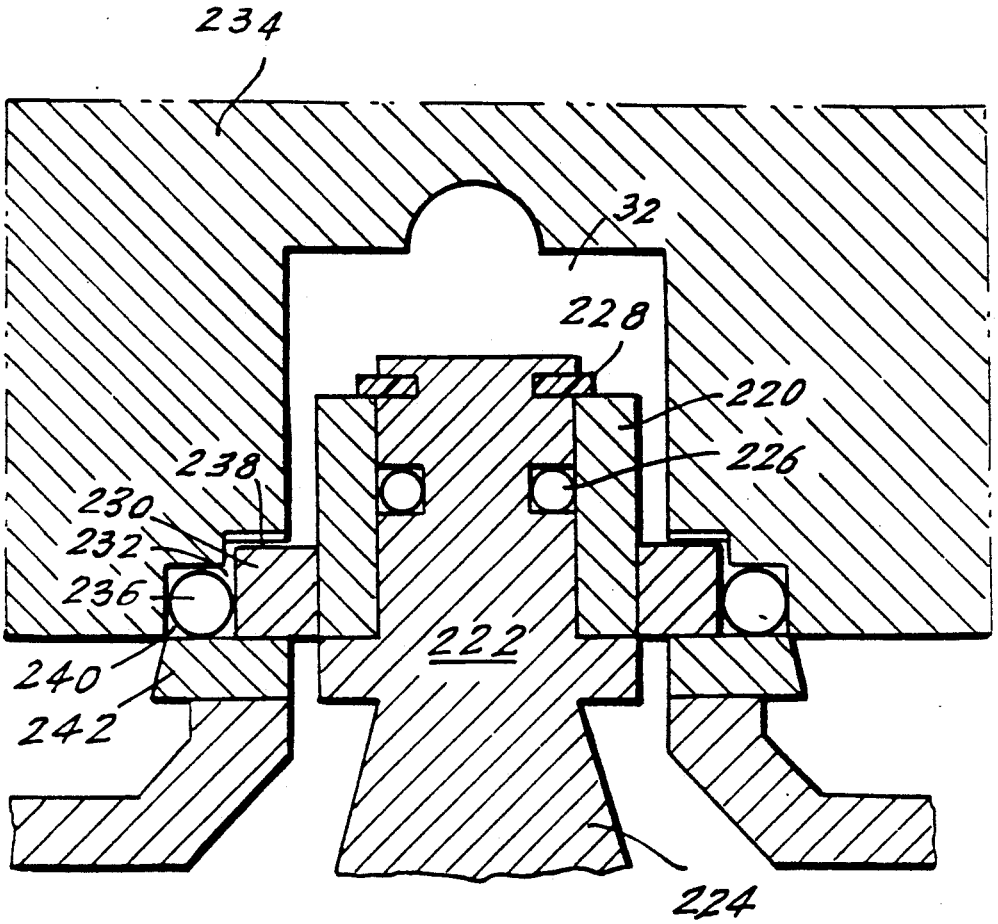
FIG. 6 shows a modified seal arrangement and sleeve retention for the pump cylinder/piston of FIG. 5.

An alternate piston sealing arrangement is depicted in FIG. 6. In this embodiment, a cover 220 surrounds the piston head 222 of the piston 224 and first and second seals 226 and 228 provide sealing between the cover 220 and the piston head 222 to prevent liquid leakage therebetween.

Figure 5:
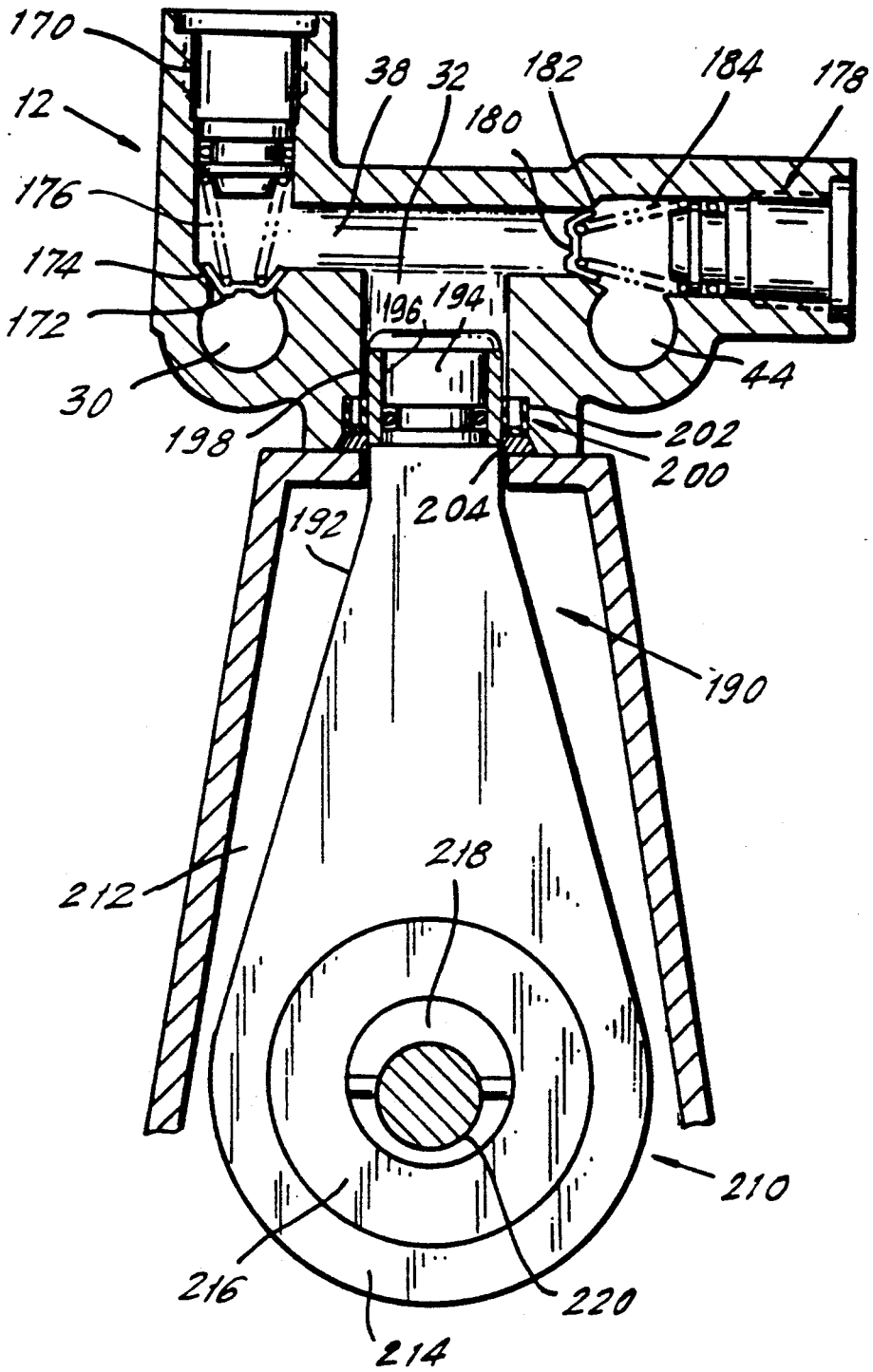
FIG. 5 is a cross-section through the pressure washer, showing one of the cylinders of the pump with a first type of seal arrangement.

Further, in place of the U-shaped seal 202 of FIG. 5, the present embodiment provides a sealing ring 230 which is partially disposed in the notch 232 in the cylinder block 234 and provides sealing between the cover 220 of the piston head 222 and the cylinder 32.

Preferably, the sealing ring 232 is selected as a Shambam Glydring which is a PTFE (Teflon) ring, and has a rectangular section with chamfered edges on the bore to allow easy assembly. The PTFE material is impregnated with glass fiber for stability and other components such as self-lubricating intensifiers to improve the frictional performance. The sealing ring 230 is used in conjunction with a nitrile O-ring 236 which is mounted around the outside diameter of the sealing ring 230 and which serves to energize the sealing ring 230 under hydraulic pressure.

It is important that the PTFE sealing ring 230 have about a 0.1 mm axial clearance 238 at the top of the notch 232 to allow it to tilt with the piston head 222 as the piston 224 wobbles while it reciprocates. The profile of the O-ring cavity 240 is modified from that normally recommended to reduce O-ring movement and extrusion. The sealing ring 230 and the O-ring 236 are supported from below by the seal support 242 in the notch 232. The O-ring 236 provides sealing against liquid leakage around and between the interior walls of the cylinder and the sealing ring 230.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A pressure washer for delivering liquid under pressure, the pressure washer comprising:

a spray nozzle for spraying liquid;

an outlet conduit connected for delivering liquid to the spray nozzle; an inlet conduit for receiving liquid from a liquid supply; a pump connected between the inlet conduit and the outlet conduit and effective for pumping liquid from the inlet conduit to the outlet conduit;

actuation means connected with the spray nozzle for selectively permitting or blocking exit from the spray nozzle of liquid pumped by the pump;

a bypass conduit connected between the inlet conduit and the outlet conduit and in parallel with the pump; and a liquid bypass system associated with the bypass conduit for selectively closing and opening the bypass conduit to flow of liquid through the bypass conduit, the bypass system including:

a bypass chamber in liquid communication with the bypass conduit, the bypass chamber having a chamber inlet in fluid communication with the outlet conduit for receiving liquid from the outlet conduit and having a chamber outlet for delivering liquid to the outlet conduit;

a shuttle so shaped and so movable in the bypass chamber between a first position in which the shuttle blocks fluid communication between the bypass chamber and the bypass conduit and a second position which permits fluid communication between the bypass chamber and the bypass conduit;

the shuttle having a first surface area in the bypass chamber which is exposed to liquid pressure at the chamber inlet and having a second surface area in the bypass chamber which is exposed to liquid pressure in the chamber outlet;

a liquid passage which extends through the shuttle from the first to the second surface areas of the shuttle; the liquid passage being narrowed in cross-section sufficiently for producing a pressure drop in the bypass chamber across the shuttle from the first to the second surface areas when liquid is passing through the liquid passage; the first and second surface areas of the shuttle are so constructed and dimensioned and the liquid passage is of sufficiently narrowed cross-section for producing a sufficient pressure drop that the shuttle becomes disposed in the first position when liquid is exiting from the spray nozzle while liquid is passing through the liquid passage for causing the liquid pressure at the chamber inlet to be greater than the liquid pressure at the chamber outlet by a predetermined amount, and otherwise the shuttle is moved, by the liquid pressures at the chamber inlet and the chamber outlet, toward the second position.

2. The pressure washer of claim 2, wherein the shuttle has an axis along which the shuttle moves in the bypass chamber, and the liquid channel passes generally axially through the shuttle.

3. The pressure washer of claim 2, wherein the shuttle has a substantially circular cross-section.

4. The pressure washer of claim 2, further comprising first and second seals disposed axially spaced apart and extending circumferentially around the shuttle, the first seal being so placed with respect to the chamber inlet and the bypass conduit and the bypass chamber being so shaped and dimensioned as to seal the chamber inlet from the bypass conduit in the first position of the shuttle;

and the second seal being so placed with respect to the chamber inlet and the bypass conduit and the bypass chamber being so shaped and dimensioned as to seal the chamber outlet from the bypass conduit in all positions of the shuttle.

5. The pressure washer of claim 4, wherein the bypass chamber has first, second and third axially extending and cross-sectionally differently sized axial regions; the first region being toward the chamber inlet and having a larger cross-section, the second region being toward the chamber outlet and having an intermediate cross-section, and the third region having a smaller cross-section and being disposed between the first and the second regions;

the first seal extending around a portion of the shuttle which is movable between the first and third regions of the chamber, and the second seal extending around another portion of the shuttle which places the second seal at all times in sealing and sliding contact with a wall of the bypass chamber which defines the second region.

6. The pressure washer of claim 5, wherein the first seal has the cross-section of the third region of the bypass chamber so that the first seal is in sealing and sliding contact with a wall of the bypass chamber which defines the third region.

7. The pressure washer of claim 6, wherein the second seal has the cross-section of the second region of the bypass chamber.

8. The pressure washer of claim 5, wherein the bypass conduit meets the bypass chamber in the third region thereof.

9. The pressure washer of claim 8, wherein the first position of the shuttle places the first seal in contact with a wall of the bypass chamber which defines the third region and the third region is so placed that the first seal blocks liquid communication from the bypass chamber to the bypass conduit when the shuttle is in the first position; and the second position of the shuttle places the first seal such that it is radially spaced from a wall of the bypass chamber defining the first region of the bypass chamber and is spaced in a manner for permitting liquid flow from the bypass chamber to the bypass conduit.

10. The pressure washer of claim 4, wherein the liquid passage includes an upstream portion that is toward the first surface area and a downstream portion that is narrowed in cross-section and is in the region of the passage that is toward the second surface area.

11. The pressure washer of claim 4, further comprising a further liquid conduit opening into the bypass chamber at the third region and effective for introducing into the bypass chamber an additional liquid.

12. The pressure washer of claim 11, wherein the further liquid conduit is disposed at a location in the third region which is between the chamber outlet and the second seal, in all positions of the shuttle.

13. The pressure washer of claim 12, further comprising a one-way valve for enabling fluid to flow unidirectionally through the further liquid conduit into the chamber.

14. The pressure washer of claim 2, wherein the bypass chamber is defined by a neck which extends from a housing associated with the pumping means.

15. The pressure washer of claim 14, wherein the neck comprises means for securing thereto a hose coupling associated with the spray nozzle.

16. The pressure washer of claim 2, wherein the pump comprises:

a cylinder and a piston reciprocable within the cylinder, the piston having a peripheral wall and a cross-sectional size which is smaller than the cross-section of the cylinder providing a radial clearance between the cylinder and the piston;

an annularly extending notch in the cylinder;

a first piston seal in the notch and a second piston seal extending between the first seal and the peripheral wall of the piston, the second piston seal being partially disposed in the notch, the first and second piston seals being effective to enable the piston to wobble relative to an axis of the cylinder while maintaining a liquid seal between the first and second piston seals and between the second piston seal and the wall of the piston.

17. The pressure washer of claim 16, wherein the piston further comprises a cover around the piston, which comprises the wall of the piston.

18. The pressure washer of claim 17, further comprising a further sealing means disposed between the cover and the piston covered by the cover.

19. The pressure washer of claim 17, further comprising a seal support disposed adjacent the first and second piston seals in a manner which is effective to retain the first and second seals in the notch.

20. The pressure washer of claim 16, wherein the pump comprises a plurality of the cylinders and a respective one of the pistons in each of the cylinders.

21. The pressure washer of claim 1, wherein the liquid passage includes an upstream portion that is toward the first surface area and a downstream portion that is narrowed in cross-section and is in the region of the passage that is toward the second surface area.

22. A pressure washer for delivering liquid under pressure, the pressure washer comprising:

a spray nozzle for spraying liquid;

an outlet conduit connected for delivering liquid to the spray nozzle; an inlet conduit for receiving liquid from a liquid supply; a pump means connected between the inlet conduit and the outlet conduit and effective for pumping liquid from the inlet conduit to the outlet conduit;

actuation means connected with the spray nozzle for selectively permitting or blocking exit from the spray nozzle of liquid pumped by the pump;

a bypass conduit connected between the inlet conduit and the outlet conduit and in parallel with the pump;

a cylinder and a piston reciprocable within the cylinder, the piston having a peripheral wall and a cross-sectional size which is smaller than the cross-section of the cylinder providing a clearance between the cylinder and the piston;

an annularly extending notch in the cylinder;

a first piston seal in the notch and a second piston seal extending between the first piston seal and the peripheral wall of the piston, the second piston seal being partially disposed in the notch, the first and second piston seals being effective to enable the piston to wobble relative to an axis of the cylinder while maintaining a liquid seal between the first and second piston seals and between the second piston seals and the wall of the piston.

23. A pressure washer for delivering liquid under pressure, the pressure washer comprising:

a spray nozzle for spraying liquid;

an outlet conduit connected for delivering liquid to the spray nozzle; an inlet conduit for receiving liquid from a liquid supply; a pump connected between the inlet conduit and the outlet conduit and effective for pumping liquid from the inlet conduit to the outlet conduit;

actuation means connected with the spray nozzle for selectively permitting or blocking exit from the spray nozzle of liquid pumped by the pump;

a bypass conduit connected between the inlet conduit and the outlet conduit and in parallel with the pump; and a liquid bypass system associated with the bypass conduit for selectively closing and opening the bypass conduit to flow of liquid through the bypass conduit, the bypass system including a bypass chamber, in liquid communication with the bypass conduit, and having a chamber inlet in fluid communication with the outlet conduit for receiving liquid from the outlet conduit and a chamber outlet for delivering liquid to the outlet conduit;

a shuttle in and movable axially along the bypass chamber; the shuttle having an inlet side facing toward the entrance of liquid into the bypass chamber and having an outlet side facing toward the exit of liquid from the bypass chamber into the outlet conduit; the shuttle being so shaped and being movable in the bypass chamber between a first position in which the shuttle blocks fluid communication between the bypass chamber and the bypass conduit and a second position which permits fluid communication between the bypass chamber and the bypass conduit; the shuttle and the bypass chamber being sized so that the surface area of the shuttle inlet side is smaller than the surface area of the shuttle outlet side, for normally urging the shuttle to the second position when the pressure in the bypass chamber at the outlet side of the shuttle approaches the pressure in the bypass chamber at the inlet side of the shuttle;

a liquid passage through the shuttle from the inlet side to the outlet side, the passage including a narrowed region for defining a pressure drop across the shuttle when liquid flows from the spray nozzle and through the outlet conduit, and the surface areas of the inlet and outlet sides being so sized and the narrowed region of the liquid passage being of such cross-section that the pressure drop reduces the pressure at the outlet side of the shuttle as to cause the pressure at the inlet side of the shuttle to move the shuttle to the first position.

24. The pressure washer of claim 23, further comprising first and second seals disposed axially spaced apart and extending circumferentially around the shuttle, the first seal being so placed with respect to the chamber inlet and the bypass conduit and the bypass chamber being so shaped and dimensioned as to seal the chamber inlet from the bypass conduit in the first position of the shuttle; and the second seal being so placed with respect to the chamber inlet and the bypass conduit and the bypass chamber being so shaped and dimensioned as to seal the chamber outlet from the bypass conduit in all positions of the shuttle.

25. The pressure washer of claim 23, wherein the liquid passage includes an upstream portion that is toward the first surface area and a downstream portion that is narrowed in cross-section and is in the region of the passage that is toward the second surface area.

* * * * *